US005259581A

United States Patent [19]

Goldberg

[11] Patent Number: 5,259,581

[45] Date of Patent: Nov. 9, 1993

[54] INVERTED BOOK HOLDING AND PAGE TURNING DEVICE

[76] Inventor: Herbert E. Goldberg, 195 Heath's Bridge Rd., Concord, Mass. 01742

[21] Appl. No.: 855,197

[22] Filed: Mar. 23, 1992

[51] Int. Cl.[5] ..... A47B 5/04

[52] U.S. Cl. ..... 248/444.1; 248/445; 248/447.2; 248/454

[58] Field of Search ..... 248/444.1, 441.1, 444, 248/445, 447, 447.2, 448, 451, 452, 453, 454, 457, 460

[56] References Cited

U.S. PATENT DOCUMENTS

| | | | |
|---|---|---|---|
| 872,905 | 12/1907 | Connors | 248/441.1 X |
| 2,638,701 | 5/1953 | Dahlgren | 248/444.1 X |
| 2,908,465 | 10/1959 | Lykes | 248/460 X |
| 3,350,150 | 10/1967 | Schwarm | 248/454 X |
| 4,465,255 | 8/1984 | Hill | 248/441.1 X |
| 4,754,945 | 7/1988 | Diamond | 248/460 |
| 4,867,407 | 9/1989 | Becker | 248/444.1 |
| 5,129,616 | 7/1992 | Carson | 248/444.1 X |

FOREIGN PATENT DOCUMENTS

| | | | |
|---|---|---|---|
| 191568 | 10/1956 | Austria | 248/454 |
| 920537 | 11/1954 | Fed. Rep. of Germany | 248/454 |
| 1518012 | 2/1968 | France | 248/441.1 |
| 391993 | 5/1965 | Switzerland | 248/455 |
| 1525080 | 9/1978 | United Kingdom | 248/454 |

*Primary Examiner*—J. Franklin Foss

[57] ABSTRACT

A book holding structure is provided having means to position the book in two positions, one for turning the pages of the book and the other for reading.

32 Claims, 4 Drawing Sheets

Sec.2-2

SEC.2-2

INVERTED BOOK HOLDING AND PAGE TURNING DEVICE

SUMMARY OF THE INVENTION

This invention is directed to an improved inverted book holder, which permits pages to be turned safely by a person in a reclining or supine position, does not require any readjustments as the size or nature of the reading material is changed, and allows easy setting of the reading distance.

BACKGROUND OF THE INVENTION

This invention is concerned with improvements of the devices used to position books and other reading matter for persons who find it difficult to hold such matter securely in their hands, especially while reclining or while resting in a supine position. Some are in this situation because of arthritis, others must lie on their backs while recovering from surgery or injuries, still others just find it uncomfortable to hold reading matter, especially tightly bound "paperbacks", while resting on a sofa or in bed.

For over sixty years much effort has gone into the design of supports to hold reading matter in an inverted position, using retaining clamps and springs, as well as transparent easels. However, only a very few of these devices have addressed the problem of turning pages, which is the most serious obstacle to reading from a supine position.

THE PRIOR ART

The designs disclosed in the prior art are mechanically complex, requiring the sliding about of spacing plates, retaining rods or springs by the user, and the loosening and tightening of wing nuts or the moving of leaf springs whenever reading material is inserted, particularly if there is a change of size or thickness. They were not designed to hold magazines, newspapers, or small items such as letters or photographs, and do not provide for easy adjustment of the reading distance, a crucial need for those above age 45 or 50, who depend on bifocal glasses to compensate for their reduced range of visual accommodation.

Most importantly, many of the prior devices do not protect the user adequately from injury by books falling from the book holder when pages are being turned.

It thus appears that the prior art has not addressed the needs of persons unfamiliar with things mechanical, and the requirements of the handicapped and elderly.

Ferraro, U.S. Pat. No. 5,058,843

Contrary to the views expressed in this U.S. Pat. No., it is believed that a forward angle of tilt of 50 or 60 degrees rather than 90 degrees is best for reading from a supine position, because of the muscular relationship between visual convergence and accommodation and the direction of the line of sight, which is acquired during early childhood. The line of sight is depressed further for those people above age 45 or 50, who must read through the lower segments of their bifocal glasses.

It is also believed that the procedure of sliding out a page that is pressed against plate 35, feeding it through opening 39, and then inserting it under leaf spring 43, requires a handy person indeed, and that it would be difficult to adjust the height of the plate frame 31 from a supine position as the book thickness changes.

Romaniuk, U.S. Pat. No. 2,610,434

The adjustments for book thickness (Col.3, lines 1–15), and book size (Col.2, lines 39–45), seem too difficult to be done from a supine position, as well as unsafe if done while the device is in the reading position (Col.3, line 66).

The mere possibility that reading material may fall onto the user's face as the bookholder structure 10 is turned into the reading position, would render the device unacceptable for general use.

In the tests described below it was found difficult to turn pages by their lower corners as shown in FIG. 2 of the patent, and that a full length cross bar 12 would restrict access to the important upper corners of the book.

Motono, U.S. Pat. No. 1,609,180

The device requires the page holding member 28 to be adjusted (page.1, line 102–112) according to calibration marks to be read by a person, who is in a reclining position, and unable to check manually whether the adjustment is safe enough to keep the book from falling.

Furthermore, the automatic turning mechanism does not take account of the fact that many books, particularly "paperbacks", do not lie flat until well worn As books are positioned at 20 or 30 degrees from the vertical, pages will not lie as shown in FIG. 3 of the patent but will turn spontaneously, and often stand straight up. The extended pages will be crushed and jammed by the page holding members 28 and 29, whether rods or plates, as they approach head on, unless the user can hold the book against the back plate 15, keep the two facing pages flat, and turn the book holder to the reading position, all at the same time and from a reclining posture.

Examiner's References

The thirteen U.S. references cited in the patents above have been noted.

OBJECT OF THE INVENTION

It is an object of the invention to provide an improved book reading means, whereby a person of minimal mechanical dexterity may read from a supine or reclining position, turn pages and handle material of many sizes and shapes without having to make mechanical adjustments.

It is another object of the invention to provide means to prevent reading matter from falling from the book holder when pages are being turned, and to permit its safe use by persons who at times may fall asleep. It is still another object of the invention to provide simple means allowing the user to adjust the viewing distance of the material to be read and the viewing angle at which it is presented.

THE INVENTION

In the following description as well as in the claims the term "book" or "books" will represent all reading matter, including magazines, letters, newspapers, photographs, and any other matter being examined visually.

The invention addresses the above mentioned problems of holding books by:

(1) providing a transparent safety surface of suitable contour, on which a book may be placed face down, and applying sufficient constraints to the back of the book to flatten it if necessary, and to prevent pages from curling up or turning spontaneously.

(2) providing a second surface or a frame, positioned in back of the above mentioned safety surface to support the back of the book while pages are being turned.

(3) providing means of moving the book between the two surfaces referred to above.

(4) providing safety means to prevent injury to the user by preventing an accidental release of the book from the holder.

(5) providing convenient ways of adjusting the reading distance and the viewing angle best suited to the user.

DESCRIPTION OF THE INVENTION

Figure 1A:
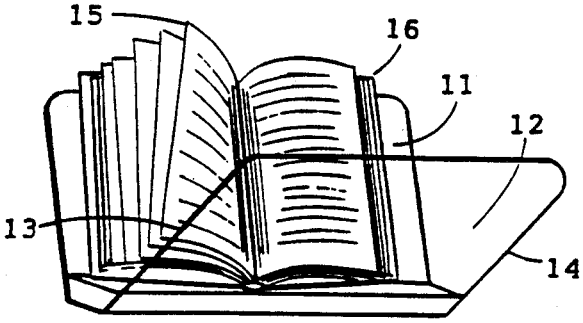
FIGS. 1*a* and 1*b* are perspective views of a test model, built to explore the practicality of the invention.
Figure 1B:
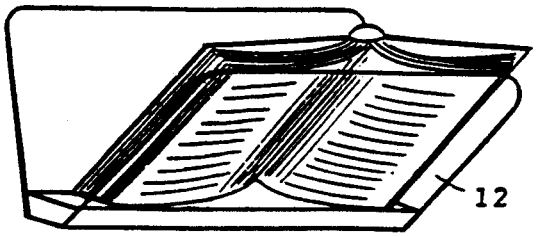

FIGS. 1*a* and 1*b* illustrate a test device, built to explore the practicality of the invention described above. The plate 11 faces backward and supports the book when the user wishes to turn pages (FIG. 1*a*). Whenever the user wishes to read or view the book from a supine or a reclining position, he moves it forward against the transparent safety front plate 12 (FIG. 1*b*), which thus is positioned at all times between the book and the person viewing it.

The book shown in FIGS. 1*a,b* is of the hard cover type and somewhat worn. It thus lies flatter on plates 11 and 12 than the "paperbacks" shown in FIGS. 3, 5 and 6 described below.

The following observations were made in practical trials of the device of FIGS. 1*a* and *b*.

1. Reading Position (FIG. 1*b*)

Viewing and reading were excellent. The best forward tilt of plate 12 was 20 to 30 degrees from the vertical, but tilts as low as 5 degrees and as high as 60 degrees were found useful for readers suffering from certain disabilities, such as being unable to lower the head while seated, or having to lie on a flat surface with only minimal head support. 2. Page Turning Position (FIG. 1*a*)

Figure 2A:
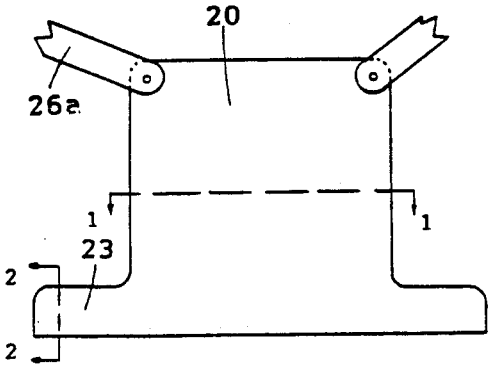
FIGS. 2*a,b,c* and 2*d,e,f* are front and cross-sectional views of two front plates used in certain embodiments of the invention.
Figure 2C:
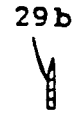

When the book was placed in the page turning position, the sides 13 and 14 of front plate 12 interfered severely with access to the upper corners 15 and 16 of the book, which are the best areas to grasp the pages to be turned. The width of the front plate 12 should thus be reduced to less than ten inches, either all the way up as shown on plate 20, FIG. 2*a*, or by narrowing the width of the plate for a portion of its height on one side, or on both sides as outlined by contour 22, FIG. 2*d*. It was found that a front plate width of five to seven inches at the narrowest point provides excellent access to the upper page corners, where the hand motion required for page turning is most natural. This still covers the width of the printed page area of an average book. The book can be moved horizontally to read adjacent pages if this is considered desirable.

Wings 23, 24 and 25 may extend along the top and bottom edges of plates 20 and 21 to keep the corners of the book from curling down when it is in the reading position. They do not interfere with the turning of pages in any way. Swivelinq extensions 26*a,b* and 27 similar to those commonly used on music stands, can be added at the upper corners of either plate or to its lower wings to support the extreme corners of newspapers or other large reading matter.

Figure 2B:
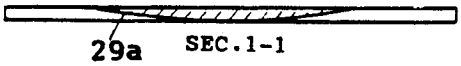
Figure 2F:
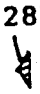
Figure 2D:
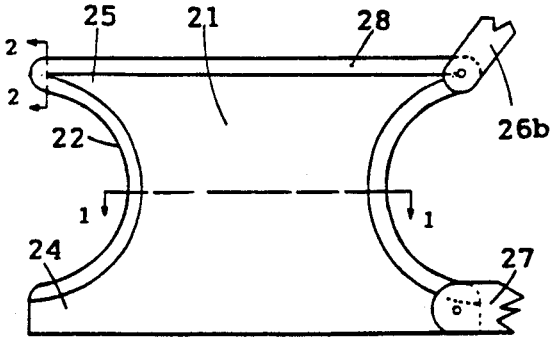
Figure 2E:
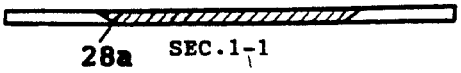

The optical discontinuity of reading across the edges of plates 20 and 21, although not serious, can be eliminated almost completely by molding some of their areas into very weak plano-convex lens shapes 29*a,b*, FIG. 2*b,c* or by beveling their edges 28*a,b*, FIG. 2*e,f* or by using a combination of the two methods.

Figure 3A:
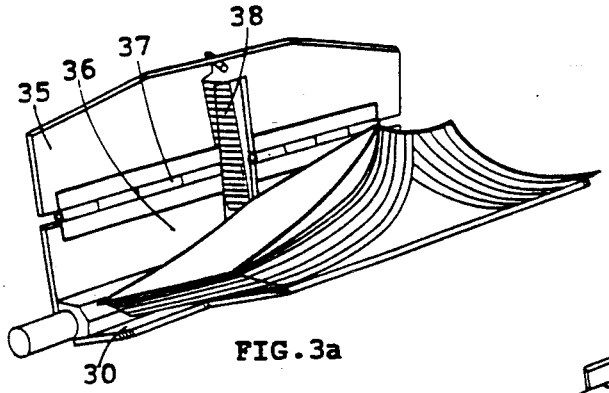
FIGS. 3*a,b,c* are perspective and side views of one way of carrying out the invention.
Figure 3B:
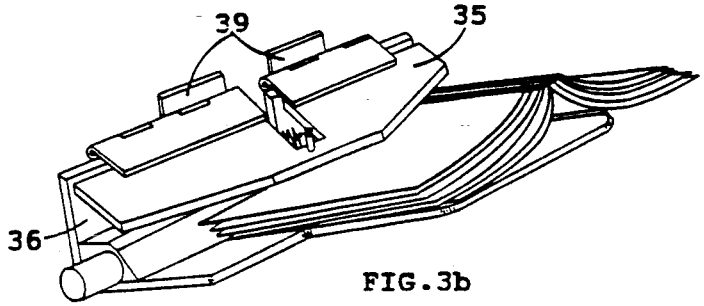
Figure 3C:
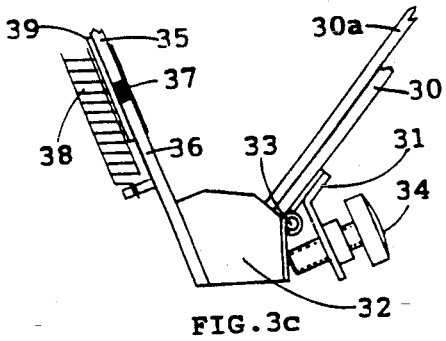

Access to the important top corners of the book can be improved significantly if the back tilt of back plate 11, FIG. 1*a*,is held to the minimum required for stability, about 10 to 30 degrees from the vertical. However, the included angle between plates 11 and 12 should be above 30 degrees to allow sufficient clearance for the turning of pages. An angular separation of 50 degrees between plates 11 and 12, combined with a spacing of one to two inches at the bottom of the cavity formed by them, proved very satisfactory. for general use, but included angles up to 90 degrees are useful in some applications FIGS. 3*a,b,c* show an embodiment of the invention designed in response to the trial results described above. The transparent front safety plate 30, FIG. 3*a*, is similar in contour to plate 20, FIG. 2*a*. It is attached to a bent metal plate 31, FIG. 3*c*, and connected to the base 32 of the device by a horizontal hinge 33, FIG. 3*c*, positioned behind the bend of plate 31. An adjustment screw 34 is threaded into plate 31 at a point located below the hinge axis. It bears against the base 32 of the device and serves to adjust the angle of tilt of the front safety plate 30, depending on the needs of the user.

The back plate of the device has been divided horizontally into two portions, with the upper portion 35, FIG. 3*a*, acting as a book flattener. The lower portion 36 is fixed to the base 32, FIG. 3*c*, of the device, tilted back at approximately 20 degrees to the vertical. The two portions 35 and 36 are connected by a horizontal hinge 37, FIGS. 3*a* and *d*. A toggle spring 38 is placed between the two portions of the back plate, so as to urge the upper portion either backward (FIG. 3*a*) against the stops 39, which are attached to the lower back portion 36, FIG. 3*c*, or forward against the back of a book resting on the front safety plate 30, FIG. 3*b*. The book flattening action of this toggle spring, coupled with the wedging action taking place between plate 35 and the back of a paperback book is seen by comparing FIGS. 3*a* and 3*b*

It should be noted that the device shown in FIGS. 3*a,b* above, although being open on top and on both sides, protects the user from falling books. It may be used to view large items such as newspapers and picture magazines by placing a sufficiently large, stiff, and transparent plastic sheet 30*a*, FIG. 3*c*, between such large items to be viewed and the front safety plate 30 of the device.

Figure 4A:
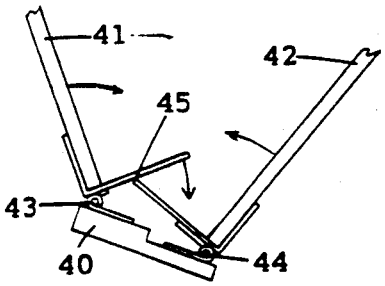
FIGS. 4*a* and 4*b* are perspective and side views of another way of carrying out invention.
Figure 4B:
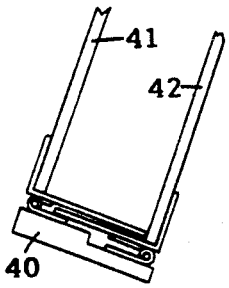

FIGS. 4*a* and 4*b* show a clamshell device, which automatically flattens the book as it is brought into the viewing position. Plates 41 and 42 are mounted to rotate about hinges 43 and 44, FIG. 4*b*, which are attached to the base plate 40. As back plate 41 is brought up from the page-turning position to the reading position, it rises from an approximate 20 degree back tilt (page-turning) to an approximate 20 degree forward tilt (reading), and a cam action is generated along the line of contact 45, FIG. 4*a*, which causes the safety front plate 42 to rise from an approximately 40 degree forward (page turning) tilt to an approximately 20 degree forward (reading) tilt. Thus, both plates rotate and become parallel as they move into their reading positions, thereby constraining and flattening tightly bound books, especially paperbacks. This action occurs regardless of the size of the book, which remains separated from the viewer at all times by the front safety plate 42.

Figure 5A:
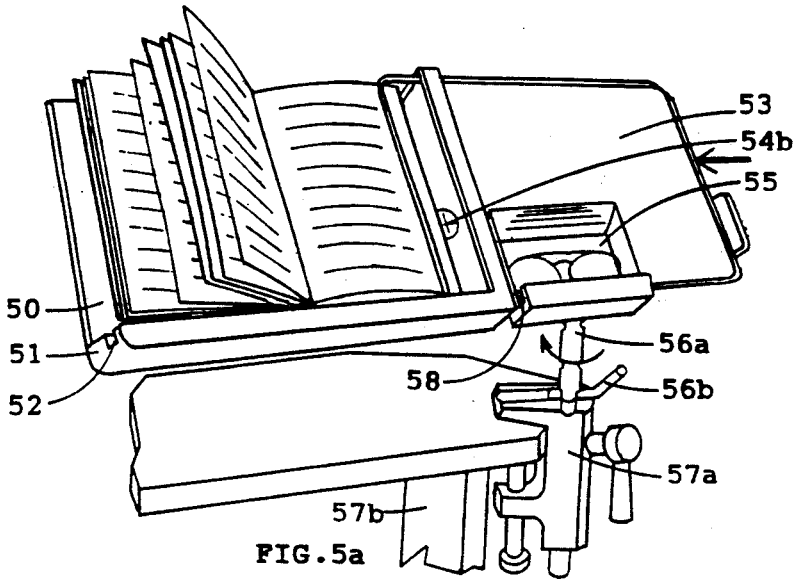
FIGS. 5*a,b,c,d* and 6*a,b,* respectively, are views of still other ways of carrying out the invention.
Figure 5B:
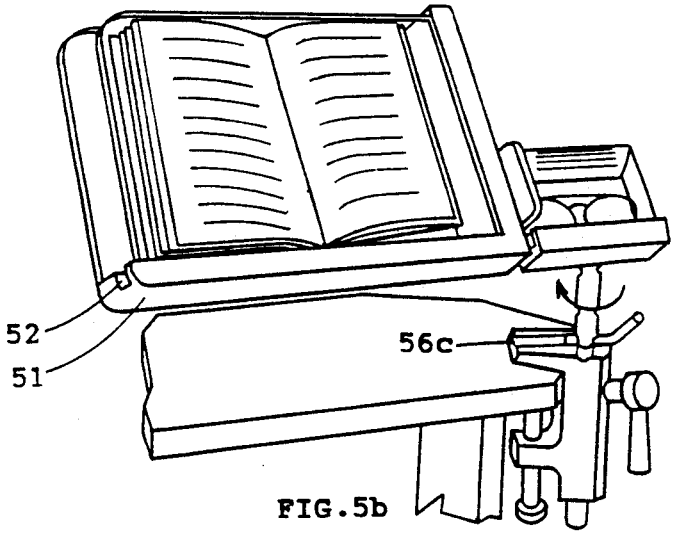

FIGS. 5*a,b,c,d* show a reading device, which employs the same parallel plate book flattening system as the clamshell design above, but uses a movable casing or holder 51 to hold the book. FIG. 5*a* shows the device in the page-turning position, facing up. The casing 51 is supported by a shaft 54*b*,FIGS. 5*a* and 5*d*, which extends into a horizontal bearing tube 54*c*. This tube is attached to a supporting member 55, which can be used as an eyeglass holder. It is supported by the vertical post 56*a* and the table clamp 57*a*, FIG. 5*a*.

A transparent front safety plate 53 is supported by, and slides along a groove 52 positioned along the bottom edge of casing 51, FIGS. 5*a,b*. In the open position shown in FIG. 5*a*, the front safety plate is also supported by a groove 58, FIGS. 5*a,c,d*, positioned along the bottom edge of the eyeglass holder 55, The presence of the front safety plate 53 in both groves 52 and 58 generates a strong keying and locking action, which prevents the casing 51 from turning in the bearing tube 54*c* as long as the book is even slightly uncovered.

Figure 5C:
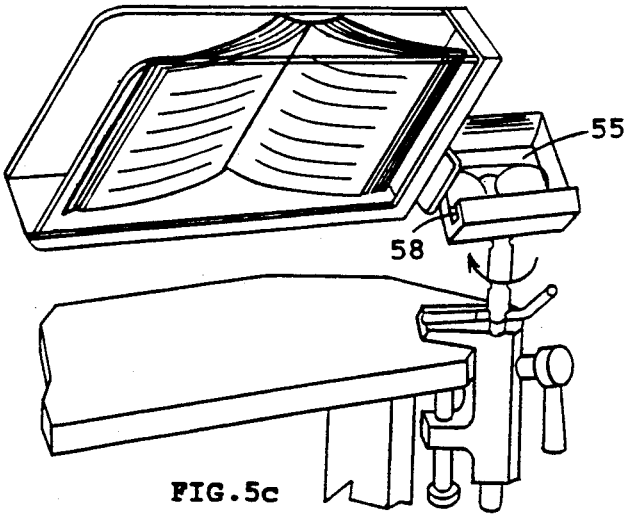
Figure 5D:
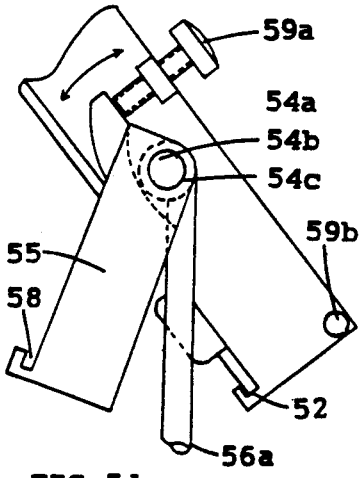

After a book has been placed against the back plate 50 of casing 51, and after pages have been turned to the desired place, the front safety plate is moved along groove 52 to cover the book. Being no longer restrained by groove 58, the closed casing may now be turned into the reading position defined by an adjustable stop 59*a*. The interference created by the misalignment of grooves 52 and 58 and the presence of the eyeglass holder 55 as shown in FIG. 5*c*, prevents the front safety plate 53 from moving until the casing has been returned to the page-turning position of FIGS. 5*a* and *b*, as defined by stop 59*b*, FIG. 5*d*.

The casing 51 may be made sufficiently large to hold an open magazine, such as Newsweek © or Time ©, and half pages of common newspapers. However, being open at the top and at one side, it can also accommodate the large plastic support sheet 30*a* described above with FIG. 3*c*.

Figure 6A:
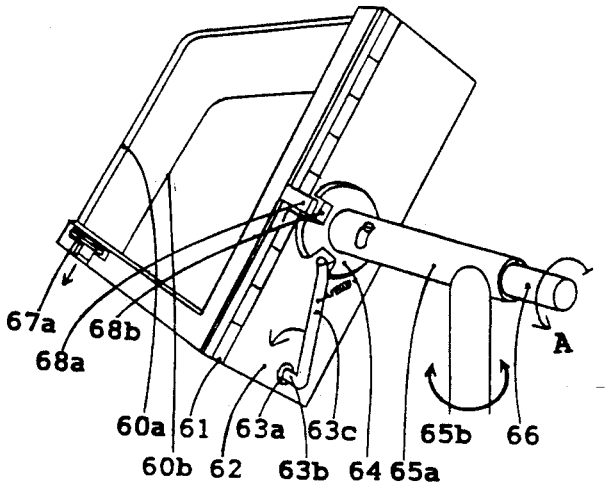

FIGS. 6*a,b* show another way of carrying out the invention, which is similar to that of FIG. 5, except that the front safety plate 60*a* is not of the sliding type, but is attached to the casing 62 by a hinge 61. It will be referred to below as a "door". The casing is attached to a shaft 66 designed to turn in a stationary bearing tube 65*a*. and may thus be turned in the direction of the arrow A, FIG. 6*a*, to bring the book into the reading position. In FIG. 6*a* the casing is shown in the loading/page-turning position with the door closed. After the door has been opened, a book may be placed against the back plate 60*b*. As the door is opened, a detent 68*a* engages the slot 68*b*, FIG. 5*a*, thereby preventing the casing 62 from being turned as long as the door is open. After pages have been turned to the desired place the door 60*a* is closed, disengaging the detent 68*a* from slot 68*b*, and allowing the casing to be turned into the book viewing position shown in FIG. 6*b*.

As the casing is turned, the detent 68*a* rides on the circular portion of cam 64, which is attached to the stationary bearing tube 65*a*, thereby preventing the door 60*a* from being opened. Additionally, the cam 64 forces the cam follower 63*c* to lock the door 60*a* to the casing 62 at its lower left corner.

Figure 6B:
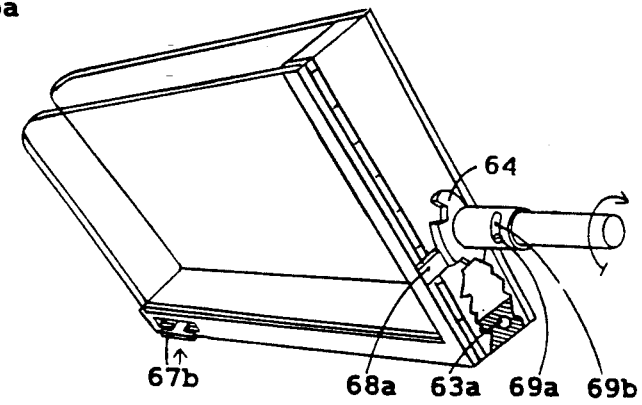

The cam follower 63*c* acts through a shaft 63*b*, which runs through a hole or slot 63*a*, placed along the bottom of casing 62. FIGS. 6*a* and 6*b* show the lock in the open and closed positions 67*a* and *b* respectively. A stop 69*a* and a slot 69*b* define the angles of tilt of the page-turning and lowest reading positions.

The interlocks between the motion of the doors and the rotation of the casings as shown in FIGS. 5 and 6 assure a safe operation of the devices. because:

(1) The casings cannot be turned away from their page-turning positions unless the front safety plates cover the books, and (2) The books cannot be uncovered unless the casings are in their page-turning positions.

The configurations of the reading device shown in FIGS. 5 and 6 are especially appropriate for users who do not have complete manual control, or who may be confused at times, or cannot be depended upon to operate a reader of this nature reliably. For such applications it may be well to design the casings 52 and 62, FIGS. 5 and 6, with both sides and the top closed, and in some instances to make provision for locking the front safety plates 52 and 62 in their book-covering positions. In the latter case books would be loaded and pages would be turned by visitors or hospital personnel. Since the devices would be large enough to hold two full pages of most books and magazines, this will give pleasure and relaxation even to people who must depend on others to turn pages for them.

The designs of FIGS. 5 and 6 involve rotation of a mechanical assembly, and thus call for consideration of weight distribution and balance. The location of the shafts 54*b*and 66, FIGS. 5*a,d* and 6*a* respectively, with respect to the loaded and unloaded casing is thus important. The best position for the axis of rotation was found to be slightly below the center of the casing, as shown in FIG. 5*a* and 6*a*. Separate right and left handed models may thus be required if one side of the casing is to be left open.

Alternatively, the axis of rotation could be placed above, below, or behind the casings and the problems of left and right handed models could be avoided, if proper balance were maintained by employing such well known expedients as counterweights and/or stabilizing springs.

SUPPORT DEVICES

The reading devices described above are designed to be placed above and in front of a user who is lying supine, reclining, or sitting in an erect or semi-erect position. They are supported by arms, which extend from the reading device to vertical posts, often positioned to the side and/or in back of the user.

For hospital use the reading devices will usually be attached to the standard hospital bedside tables, using clamp 57*a*, FIG. 5*a*, similar in design to the clamps commonly used to hold commercial desk lamps. They will hold the post 56*a* and similar vertical supports securely. The top of the bedside table may be cleared for other uses by turning the reading device out of the way as indicated by the arrows shown in FIGS. 5*a,b* or by lifting it off the clamp 57*a* all together. Detents 56*c* serve to stabilize the device in the most frequently used positions. The clamp should be attached to the bedside table at a point near the table post 57*b*, where it will not interfere with the normal hospital routine.

Figure 7:
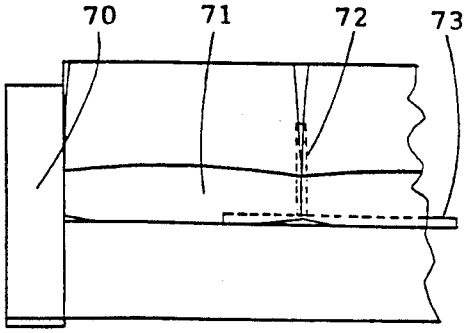
FIGS. 7 is a front view of a mounting device used to practice the invention in the home.

For use in the home, the vertical posts of the various reading devices described above would be inserted into suitable floor stands or into companion holding devices, shown in FIG. 7, where a vertical tube 72 is fastened to a platform 73 or other substantially horizontal structure. The platform is placed under the seat pillow 71 of a sofa 70, or under the mattress of a bed.

For sofa use the bottom side of the platform 73, FIG. 7, must remain flush. The tube 72 will thus project upwards, usually by eight or ten inches. It can be shielded from view by existing or added back pillows.

For use on a bed (FIGS. 8*a,b*) it is desirable to keep the top of the vertical tube 72 of FIG. 7, shown here as 84, below the surface of the mattress 81, extending upward from the platform by three or four inches. It can, however, protrude below the platform as far as needed for stability.

Figure 8A:
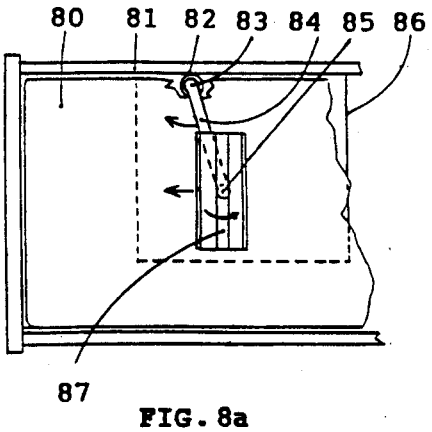
FIGS. 8*a* and 8*b* are two views of an arrangement for moving the book holder closer to or further away from the user, and also of orienting it to fit his or her needs.

FIG. 8*a* illustrates also how a user would adjust the position of the reading device to match his or her individual reading distance accurately, a very important need for those above age fifty or so, who have little or no eye accommodation left.

The reading device of FIG. 3, shown as 87 in FIG. 8*a*, for example, is connected to the horizontal arm 84 by a pivot joint 85, which cooperates with a second and parallel pivot joint 83, formed by the vertical tubular post inserted into the vertical tube 72 of the companion holding device of FIG. 7, which is shown in FIG. 8*a* as 82.

This "double pivot" suspension system allows the user to move the reading device back and forth without altering its orientation with respect to his or her line of sight, as is illustrated in FIG. 8*a* by the three arrows. The double pivot suspension system also permits the user to draw the device very close and to turn it about pivot 85 if he or she finds this position more comortable for the changing of books.

Figure 8B:
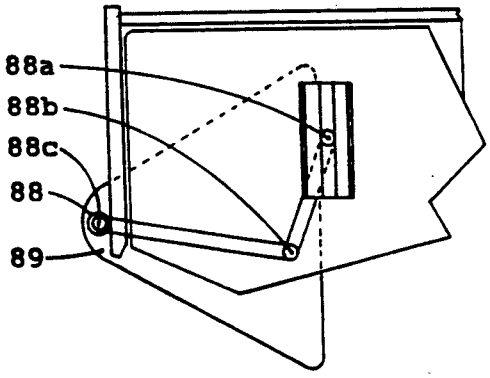

If a sideways movement is desired, for instance for installations on a double bed, the triple pivot suspension shown in FIG. 8*b* is very useful. It is composed of reader pivot 88*a*, intermediate pivot 88*b*, floor post pivot 88*c*, floor post 88 and floor platform 89. The three pivots are substantially parallel, but do not have to be co-planar The post 88 is shown at the center of the head board, where the reach is short. Although the floor stand 89 is very practical for this type of suspension, a mattress platform could be used.

The pin 53*b* of FIG. 5*c* or a clamp is used to set the height of the device, and an internal coil or Neg'tor $^R$ spring may be positioned within the vertical tube 72, FIG. 7 to take part of the weight of the device when a height adjustment is made.

Having described the invention, what I claim as new is:

1. An inverted book reading device for permitting a person in a supine position to view its contents, comprising a holder for accepting a book or book-like contents, said contents being positionable in either of two positions; a first, generally backward-tilted position for permitting the turning of pages and a second generally forward-tilted position to allow visual access to said contents, said holder including a back plate against which said contents rest when they are in said first position, and a front safety plate, being transparent and being spaced from said back plate to form therebetween a book receiving cavity, and against which said contents rest when they are in their said second position, said front safety plate supporting said contents of said holder and providing safety means to prevent said contents from falling out of said holder when the position of said contents is changed from said first to said second position.

2. A device according to claim 1. said front safety plate being less than ten inches wide for at least a portion of its height.

3. A device according to claim 2, said front safety plate being provided with at least one wing-like extension on at least one of its sides.

4. A device according to claim 1, said device comprising a base, and said front safety plate being hinged to said base.

5. A device according to claim 4, said front safety plate being provided with means for adjusting its angle of tilt.

6. A device according to claim 4, said back plate and said front safety plate being hinged to said base and being movable with respect to each other; lever means to cause movement of said front safety plate in response to movement of said back plate.

7. A device according to claim 1, said back plate comprising two portions, said two portions being connected by hinge means, and spring means acting to urge one of said portions to a forward position.

8. A device according to claim 1, said front safety plate being movably held by said holder to provide open and closed positions.

9. A device according to claim 8, said front safety plate being slidably held by said holder to provide open and closed positions.

10. A device according to claim 9, including interlock means to prevent movement of said front safety plate from said closed to said open position unless said contents are in said first position, and to prevent said positioning of said contents from said first to said second position unless said front safety plate is in said closed position.

11. A device according to claim 8, said front safety plate being hinged at to said holder to provide open and closed positions.

12. A device according to claim 11, including interlock means to prevent movement of said front safety plate from said closed to said open position unless said contents are in said first position, and to prevent said positioning of said contents from said first to said second position unless said front safety plate is in said closed position.

13. A device according to claim 1, said holder being supported by a substantially horizontal bar, said horizontal bar being supported by a structure terminating in clamp means.

14. A device according to claim 1, said holder being supported by a substantially horizontal bar, said horizontal bar being supported by a structure terminating in platform means.

15. A device according to claim 1, being supported by a structure comprising a first pivot joint having a first axis of rotation and a second pivot joint having a second axis of rotation, and said first and second axes of rotation being substantially parallel to one another, and being separated by bar means, thereby providing a means for increasing or decreasing the distance between said person and said holder.

16. A device according to claim 15, and comprising a third pivot joint, having a third axis of rotation being substantially parallel to said first and second axes of rotation, and being separated from said first and second pivot joints by bar means, thereby providing means for a sideways motion of said holder.

17. An inverted book holder accepting a book having a back and a face and pages to be turned and to be viewed by a person in a supine position, said book holder holding said book either in a page turning position or in a page viewing position, and comprising:

back support means extending upward and away from said person to support said back of said book when in said page turning position, and front safety plate means, being transparent and extending upward and forward between said book and said person to support said face of said book when in said page viewing position, and said back support means and said front safety plate means being connected by shelf means, and said book being positioned on said shelf means and being moved from said page turning position to said page viewing position after said pages have been turned and before said pages are being viewed, and said front safety plate means being operative to protect said person from injury which could otherwise be caused by an accidental fall of said book from said book holder when said book is so moved.

18. A device according to claim 17 said front safety plate being less than ten inches wide for at least a portion of its height.

19. A device according to claim 17, said front safety plate being provided with at least one wing-like extension on at least one of its sides.

20. A device according to claim 17, said device comprising a base, and said front safety plate being hinged to said base.

21. A device according to claim 20, said front safety plate being provided with means for adjusting its angle of tilt.

22. A device according to claim 20, said back plate and said front safety plate being hinged to said base and being movable with respect to each other; lever means to cause movement of said front safety plate in response to movement of said back plate.

23. A device according to claim 17, said back plate comprising two portions, said two portions being connected by hinge means, and spring means acting to urge one of said portions to a forward position.

24. A device according to claim 17, said front safety plate being movably held by said holder to provide open and closed positions.

25. A device according to claim 24, said front safety plate being slidably held by said holder to provide open and closed positions.

26. A device according to claim 25, including interlock means to prevent movement of said front safety plate from said closed to said open position unless said contents are in said page turning position, and to prevent said positioning of said contents from said page turning to said page viewing position unless said front safety plate is in said closed position.

27. A device according to claim 24, said front safety plate being hinged at to said holder to provide open and closed positions.

28. A device according to claim 27, including interlock means to prevent movement of said front safety plate from said closed to said open position unless said contents are in said page turning position, and to prevent said positioning of said contents from said page turning and to said page viewing position unless said front safety plate is in said closed position.

29. A device according to claim 17, said holder being supported by a substantially horizontal bar, said horizontal bar being supported by a structure terminating in clamp means.

30. A device according to claim 17, said holder being supported by a substantially horizontal bar, said horizontal bar being supported by a structure terminating in platform means.

31. A device according to claim 17, being supported by a structure comprising a first pivot joint having a first axis of rotation and a second pivot joint having a second axis of rotation, and said first and second axes of rotation being substantially parallel to one another, and being separated by bar means, thereby providing a means for increasing or decreasing the distance between said person and said holder.

32. A device according to claim 31, and comprising a third pivot joint, having a third axis of rotation being substantially parallel to said first and second axes of rotation, and being separated from said first and second pivot joints by bar means, thereby providing means for a sideways motion of said holder.

* * * * *

UNITED STATES PATENT AND TRADEMARK OFFICE

CERTIFICATE OF CORRECTION

PATENT NO. : 5,259,581

DATED : Novemger 9, 1993

INVENTOR(S) : Herbert E. Goldberg

It is certified that error appears in the above-indentified patent and that said Letters Patent is hereby corrected as shown below:

Column 3, line 4, the following should be insert:

Since a transparent safety surface is a concept which in practice must be part of a plate or other supporting member, the term "transparent plate" will be used below to represent any transparent member safety surface.

Signed and Sealed this

Fifteenth Day of March, 1994

Bruce Lehman

*Attest:*

BRUCE LEHMAN

*Attesting Officer*

*Commissioner of Patents and Trademarks*